US005110022A

United States Patent [19]

Dvoroznak et al.

[11] Patent Number: 5,110,022

[45] Date of Patent: May 5, 1992

[54] RIFLE SLING WITH RIFLE REST

[75] Inventors: Donald S. Dvoroznak, Harrisburg, Pa., Holtzclaw;; James O. Holtzclaw, Jr., Broomfield, Colo.

[73] Assignee: The Hunter Company, Westminster, Colo.

[21] Appl. No.: 613,244

[22] Filed: Nov. 14, 1990

Related U.S. Application Data

[63] Continuation of Ser. No. 402,077, Aug. 31, 1989, Pat. No. 5,018,652.

[51] Int. Cl.[5] ..... F41C 23/02; A45C 15/00

[52] U.S. Cl. ..... 224/150; 224/151; 224/913

[58] Field of Search ..... 224/150, 151, 153, 264, 224/907, 913; 211/64

[56] References Cited

U.S. PATENT DOCUMENTS 2,929,539 3/1960 Safreno ..... 211/64
4,401,246 8/1983 Dickison et al. ..... 224/150

FOREIGN PATENT DOCUMENTS 63244 2/1913 Fed. Rep. of Germany ..... 224/264

*Primary Examiner*—Henry J. Recla
*Assistant Examiner*—David J. Walczak
*Attorney, Agent, or Firm*—Fitch, Even, Tabin & Flannery

[57] ABSTRACT

A rifle sling includes an elongated central body portion having a pair of opposed protrusions defining therebetween a recess for receiving the rifle barrel. Ends of the rifle sling are connected to the rifle for carrying the rifle about the shoulder of a user. The body portion of the rifle sling provides a cushion as well as an aid in aiming the rifle, when rested on a support surface.

5 Claims, 2 Drawing Sheets

RIFLE SLING WITH RIFLE REST

This application is a continuation of U.S. pat. application Ser. No. 402,077, filed Aug. 31, 1989, now U.S. Pat. No. 5,018,652, issued May 28, 1991.

BACKGROUND OF THE INVENTION

The present invention pertains to rifle slings, and particularly to rifle slings having a rifle rest to aid in aiming the rifle.

DESCRIPTION OF THE RELATED ART

It is helpful when aiming a rifle in the field, to brace or support the barrel of the rifle, or the hand grip portion under the barrel, to aid in steadying the shooter's aim. When firing a rifle in a controlled environment at a target range, for example, elaborate and oftentimes bulky apparatus for steadying the rifle is employed. U.S. Pat. Nos. 1,236,947; 3,947,988; 3,964,613; 3,935,657; and Swiss Patent 144,606 show examples of structures on which a rifle may be rested. However, such constructions are relatively bulky and prove too cumbersome for use in the field.

U.S. Pat. Nos. 2,569,435; 2,991,579; and 3,225,656 show tripod-like devices which have a lighter weight, and which may be carried more easily. U.S. Pat. No. 3,022,898 shows a hanger for holding a gun consisting of light weight metal clips, and a strap for fastening the hanger to a tree trunk. West German Offenlegungsschrift 25.28.529 discloses a padded leather support providing cushioning for a supporting gun, which may be rolled up for carrying in a pocket or a game bag. These latter mentioned devices, like the tripod devices, are of a lighter weight and may be transported more easily. However, they are separate articles provided in addition to a rifleman's customary equipment, and nonetheless add to the load that must be carried about in the field from place to place.

SUMMARY OF THE INVENTION

It is an object of the present invention to provide a rifle rest incorporated in a rifle sling.

Another object of the present invention is to provide a rifle sling with a rifle rest which cushions a rifle barrel or associated hand grip from contact with a hard surface, and which steadies the rifle barrel when accurate aiming is desired.

These and other objects such will become apparent from studying the appended description taken in conjunction with accompanying drawings, are provided in a rifle sling for a rifle having an elongated barrel, comprising:

a body portion with first and second ends and a pair of opposed protrusions, defining therebetween a recess for receiving at least a portion of said rifle barrel so as to steady said barrel to aid in aiming said rifle;

first and second coupling means for coupling the first and second ends of said body portion to said rifle barrel; and said first and said second coupling means being spaced apart for connection to spaced apart portions of said rifle so that said body portion provides suspension for said rifle sling.

BRIEF DESCRIPTION OF THE DRAWINGS

In the drawings, wherein like elements are referenced alike.

DETAILED DESCRIPTION OF THE PREFERRED EMBODIMENT

Figure 1:
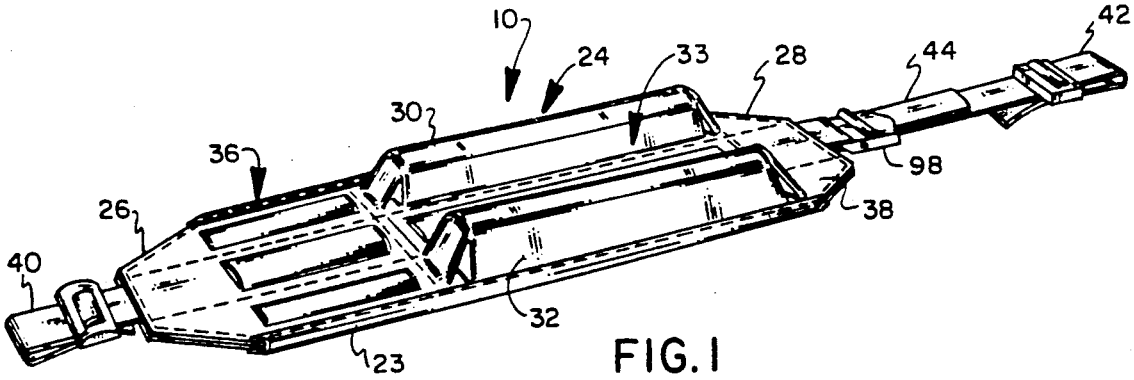
FIG. 1 is a perspective view of the rifle sling illustrating aspects according to the present invention
Figure 2:
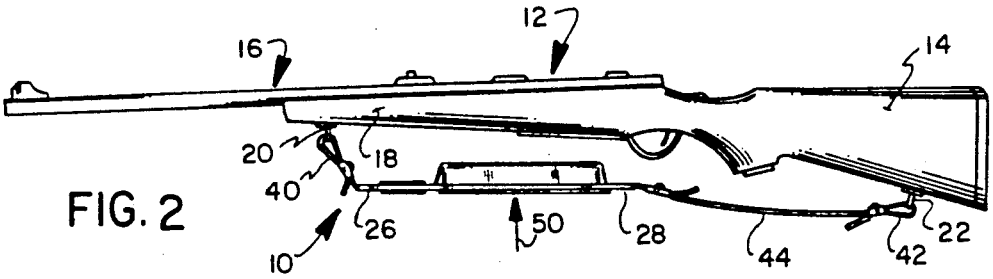
FIG. 2 is a side elevational view, of the rifle sling of FIG. 1, shown attached to a rifle.

Referring now to the drawing and initially to FIGS. 1 and 2, a rifle sling as generally indicated at 10. The rifle sling, as illustrated in FIG. 2, is attached to a rifle 12 having a stock portion 14 and an elongated barrel portion 16 which includes a hand grip 18. Link fasteners 20, 22 secure the ends of the rifle sling to the rifle in a manner to be indicated herein.

In FIG. 2, the mid-portion of rifle sling 10 is illustrated in a generally horizontal position, which it would assume when rested on a flat support surface. As will be seen, the rifle sling provides a cushioning to protect the elongated barrel of the rifle, and particularly, the hand grip 18 and provides an aiming or steadying of the rifle barrel, to assist in accurate aiming of the rifle.

Referring additionally to FIGS. 3–7, the rifle sling 10 includes base 23, havng a central elongated body portion 24, having first and second ends 26, 28. The central body portion 24 includes a pair of spaced protrusions or ribs 30, 32 which define an elongated barrel-receiving recess 34 therebetween (see FIG. 4). The ribs 30, 32 are preferably coextensive one with another, and are located toward the second end 28 of the central body portion 24. The ribs 30, 32 and their mounting to base 23 forms a barrel-receiving cradle 33.

The first end 26 includes a panel portion 36 which extends from the forward ends of ribs 30, 32. The second end 28 includes a relatively shorter panel portion 38. The panel portions 36, 38 provide a transition from the raised, elongated ribs 30, 32 to the free ends of the central body portion.

A looped strap 40 extends from free end 26 of central body portion 24. The strap 40 is looped through the link fastener 20 of rifle 12 for securement thereto. A similar looped fastener 42 is located adjacent the second end 28 of central body portion 24, but is joined thereto through a belt 44, which spans the rifle stock 14. The looped straps 40,42, the belt means 44, are adjustable in length to accommodate rifles of different sizes, so as to provide a desired positioning of the recess 34 and cradle 33, underneath the barrel portion of the rifle. By adjusting the looped straps 40, 42 and the belt 44, the cradle 33 can be shifted in opposite directions along the longitudinal axis of rifle 12.

Referring especially to FIGS. 3–7, novel features and advantages of the rifle sling will be described. It is important, for example, that the cradle portion 33 of the rifle sling be adjustable for barrels of different cross-sectional dimension, so that a single rifle sling could be used with a wide variety of rifles and other firearms. The rifle sling constructed according to principles of the present invention provides, as the name implies, a suspension of the rifle for carrying over a user's shoulder. Thus, the rifle sling is made flexible so as to conform to a wearer's anatomy.

However, it has been found important to restrict lengthwise flexing of the cradle portion 33, in order to provide a steady aiming of the rifle when placed on a wide variety of support surfaces. This latter feature is especially important for firearms which are used in the field, and which are rested on a variety of surfaces including dirt mounds, rocks, tree branches and whatever a user might find at hand at a particular field location. In particular, it has been found important to restrict longitudinal bending of the cradle, from point to point, along the length of the barrel. With reference to FIG. 2, an upward force in the direction of arrow 50 would tend to bend the cradle portion 33, along the length of the rifle barrel so that the underside surface of the cradle would assume a concave configuration. This, in turn, would cause the upper portion of the cradle to assume a convex configuration and would significantly shorten the length of the recess receiving the elongated barrel, which aids in providing a cradling stabilization thereof. As will be seen herein, the preferred construction of the rifle sling provides a balancing of the flexibility and rigidity desired, in a lightweight, economical construction.

Figure 3:
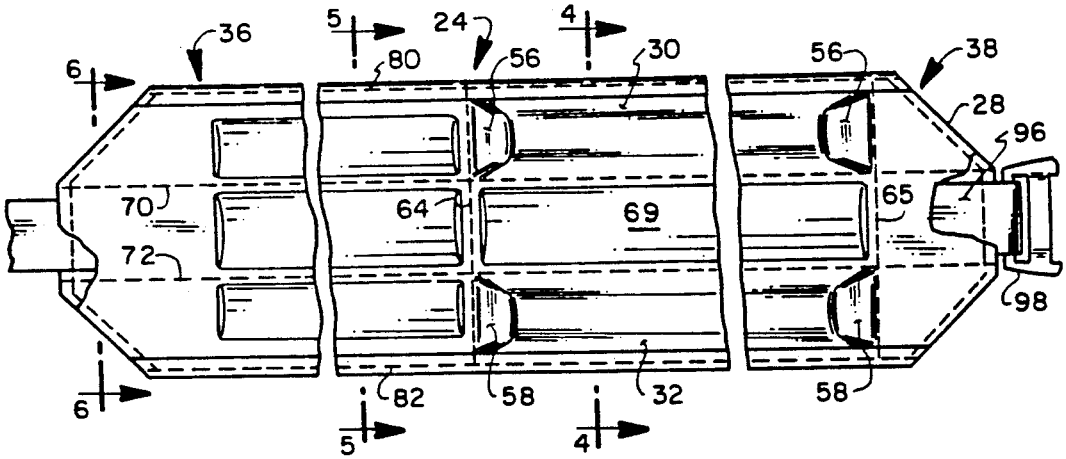
FIG. 3 is a top plan view of the rifle rest of the preceding figures.
Figure 4:
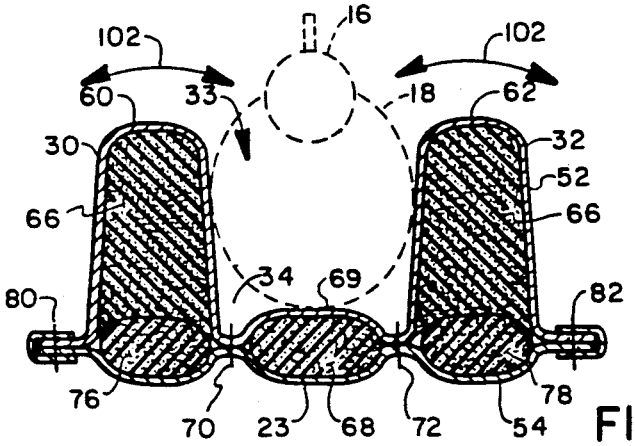
FIG. 4 is a cross-sectional view taken along the line 4—4 of FIG. 3.
Figure 7:
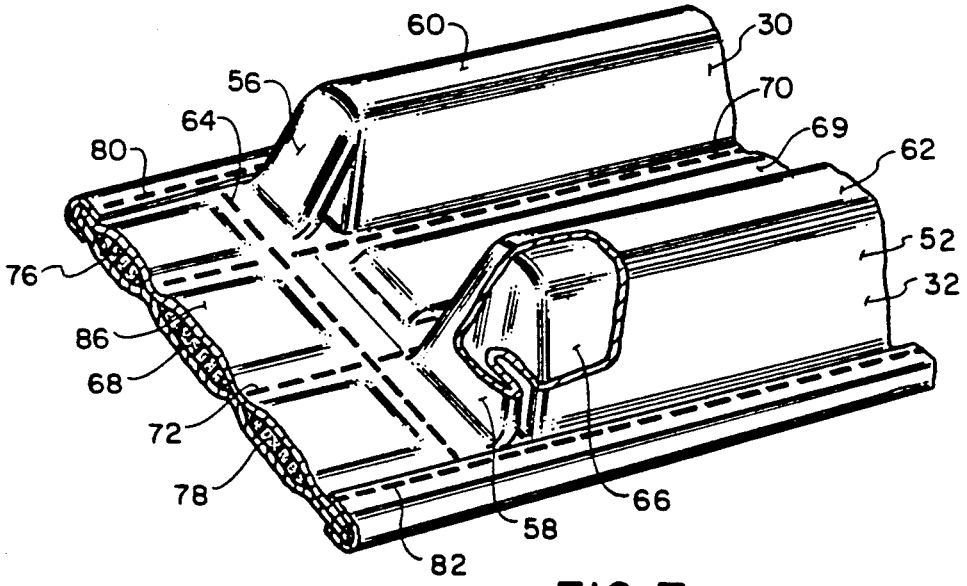
FIG. 7 is an enlarged perspective view showing the construction at one end of the rifle rest portion, in greater detail.

In the most preferred embodiment, the central portion 24 of the rifle sling is fabricated with an upper fabric layer 52, and a lower fabric layer 54, stitched together as indicated in FIG. 3 and 4. An important feature of the sling construction is illustrated in FIG. 7, wherein the upper fabric layer 52 includes folded end portions 56, 58, which either hold the upper surfaces 60, 62 in a slack free condition, or which maintain the top surfaces 60, 62 of ribs 30, 32, in a taut and/or tensioned condition. Lateral stitching 64, 65 secures the folded end portions 56, 58, to maintain the condition of the upper surfaces 60, 62 of ribs 30, 32. Any pressure against the cradle portion 33 in a direction of arrow 50, is balanced or restrained by upper surfaces 60, 62 of ribs 30, 32, and thus, any concave deformation of the lower side of cradle 33 is prevented. This construction, as will now be appreciated, is light weight and of simple construction yet has been found to effectively prevent lengthwise bending of central portion 24.

As shown in FIG. 4, the interior of ribs 30, 32 is preferably filled with a foam material 66. The foam material is compressible so as to provide a certain amount of cushioning of a rifle barrel cradled in recess 34. According to one aspect of the present invention, the foam material 66 is chosen so as to provide the necessary support of the upper fabric layer 52, so that in cooperation with the folded end portions 56, 58, the upper surfaces 60, 62 of ribs 30, 32 are maintained in a taut and/or pre-tensioned condition. For example, a closed cell foam can be chosen to optimize the aforedescribed features of rifle sling 10. More specifically, the closed cell foam can be chosen so as to provide a certain amount of compression under pressure of the rifle 12, but will effectively dampen and thereby resist significant compression of the ribs 30, 32, when the rifle sling is placed under a lengthwise bending pressure, such as that indicated by arrow 50 in FIG. 2.

Referring again to FIGS. 3 and 4, a padded web portion 69 is provided between ribs 30, 32, maintaining the ribs in a spaced condition. As mentioned, web portion 69 is preferably padded, being filled with a foam portion 68, being trapped between upper and lower fabric layers 52, 54 by longitudinally extending seams 70, 72. The foam material 68 can be chosen to be identical to the foam material 66, or can be of a relatively stiffer composition to further aid in resisting or bending of cradle portion 33.

In the embodiment illustrated in FIG. 4, foam material portions 76, 78 are trapped beneath the foam material 66, filling ribs 30, 32. The foam material 76, 78 can be identical to foam material 66 and simultaneously cast therewith, or can alternatively comprise a more rigid material, so as to offer greater resistance to bending of the cradle portion, when placed under the load such as that indicated by arrow 50 in FIG. 2. Whether the foam material portions 76, 78 are simultaneously cast with foam material 66, or are separately formed of the same or a different material, those foam portions are trapped between inner longitudinal seams 70, 72 and outer longitudinal seams 80, 82, which close the longitudinal sides of body portion 24.

Figure 5:
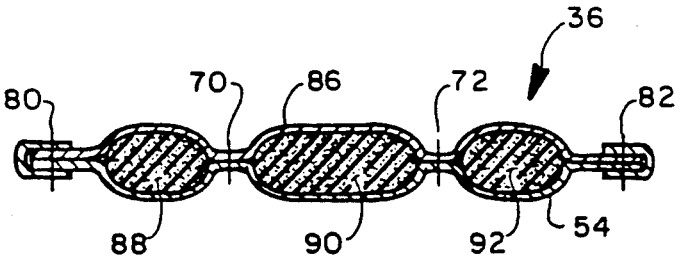
FIG. 5 is a cross-sectional view taken along the line 5—5 of FIG. 3.

Referring now to FIG. 5, the forward panel portion 36 has an interior construction similar to that of the lower portion illustrated in FIG. 4, and preferably comprises a continuous extension thereof. Preferably, the lower fabric layer 54 extends underneath the forward panel portion 36. The upper fabric covering of panel portion 36 can comprise an extension of fabric layer 52, but preferably comprises a separate fabric layer 86. The aforementioned interior seams 70, 72 and the outer seams 80, 82, join the upper and lower fabric layers 86, 54, together trapping the foam portions 88, 90, 92 therebetween. Thus, the forward panel portion 36 is constructed to provide a measure of protection for the elongated rifle barrel, should contact therewith be made. The aforementioned transverse seam 64 is preferably devoid of foam material, or substantially compresses any foam material thereat so as to function as a hinge, allowing the forward panel portion 36 to pivot in an upward direction relative to the central body portion 24, thereby providing a conformity to a wearer's anatomy when a rifle is slung over the wearer's shoulder.

Figure 6:
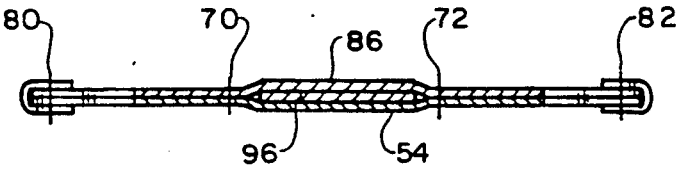
FIG. 6 is a cross-sectional view taken along the line 6—6 of FIG. 3.

Referring to FIG. 6, the lower fabric layer 54 is joined to an upper fabric layer 86 along seams 70, 72, and 80, 82. Visible in a central portion of FIG. 6, is a connecting strap 96, also shown in FIG. 3, which secures a buckle 98 to the body portion of the rifle sling. Buckle 98 provides connection to one end of belt 44.

Figure 8:
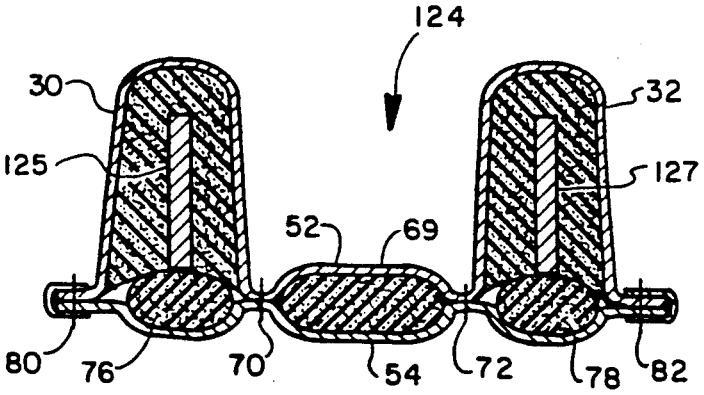
FIG. 8 is a cross-sectional view similar to that of FIG. 4, but showing an alternative internal stiffening member.

Referring now to FIG. 8, an alternative construction of the rifle sling central portion, that portion containing the cradle, is generally indicated at 124. Construction is substantially identical to the central portion 24 described above, except for the introduction of stiffening members 125, 127 disposed within ribs 30, 32, respectively. The stiffening members 125, 127 are preferably coextensive with the ribs and restrain the central body portion from concave deformation caused by the force 50, indicated in FIG. 2. The stiffening members 125, 127 are preferably made of a plastic material such as nylon, although a variety of other materials could also be chosen including wood, rubber, and metal such as aluminum. Further, the stiffening members 125, 127 could extend in generally horizontal directions, into the foam portions 76, 78. If desired, stiffening members could also be provided in the central web 69. However, as has been pointed out above, the tightening or pre-tensioning of the upper surfaces of the ribs by the cooperation of the foam interior and the folded ends 56, 58 has been found to satisfactorily prevent any such bending of the central body portion.

With reference to FIG. 4, the interior seams 70, 72 joining the centralweb 69 to the ribs 30, 32 also function as a hinge allowing the ribs 30, 32 to rotate in the direction of arrows 102 shown in FIG. 4. This also allows the cross-section illustrated in FIG. 4 to bend in a concave direction with the cradle making linear contact with the rifle barrel, further increasing the stable, non-rocking support on the surface on which the sling is rested. If desired, the contact between the cradle and rifle barrel can have a slight curvature. The hinge connection of the central web to the ribs further assures that the foam interior of the ribs will not be distorted, thus insuring the ability of the foam interior to maintain the taut prestressed condition of the upper surfaces of the ribs.

Several alternative constructions can be made while practicing the various principles according to the present invention. For example, in the preferred construction, the ribs comprise fabric-covered foam rib members. This could be replaced, for example, by a monolithic plastic or rubber construction with the sling being molded as a single piece. The benefits described above are still obtained and the construction, particularly in mass produced quantities, can be achieved with economical mass production molding techniques. If desired, stiffening member, such as those illustrated in FIG. 8, can be placed within the mold within the ribs and the backing member. As a further alternative, the fabric layers described above could be replaced with leather layers and thus other, more efficient stiffening constructions can be economically realized. However, one advantage with the preferred embodiment, according to principles of the present invention, is that the outer covering can be made of relatively inexpensive fabric and can be constructed in the manner described above, so as to obtain very significant resistance to bending along the longitudinal axis of the rifle and rifle barrel.

Also, the ribs and/or the remaining portion of the rifle sling can be replaced by a hard central core (e.g., aluminum) covered by a shock absorbing or non-scratching outer layer (e.g., plastic, rubber, leather). Removal of the hard core from the hinge lines 70, 72 will provide the necessary flexing.

With further reference to FIG. 5, the construction of the forward panel portion 36 can now be seen to comprise an extension of the lower portion of the central body 24, that portion containing the web 69. The forward and rearward panel portions 36, 38, with lower portion of central body 24, comprise a backing member upon which the ribs 30, 32 are supported. Even when the foam portions 76, 78 are formed as unitary parts of foam material 66 filling the ribs 30, 32, the lower portion of the central body 24 has been found to effectively function as a discrete, backing member and can, for purposes of analyzing the performance of sling 10, be regarded conceptually as a separate backing member, similar in construction to that illustrated in FIG. 5. Of course, if desired, a fabric layer can be interposed between the foam portions 66, 78 and 66, 76 with the ribs 30, 32 being sewn on top of a substrate identical in construction to that illustrated in FIG. 5.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A rifle sling for a rifle having an elongated barrel having a longitudinal axis, comprising:

a body portion with a base having first and second end portions and a pair of spaced, generally coextensive protrusions of substantially homogenous resilient material intermediate said end portions extending above said base, said protrusions defining therebetween a recess for receiving at least a portion of said rifle barrel so as to steady said barrel to aid in aiming said rifle, each said protrusion having an upper surface and a pair of opposed sides extending from the base to the upper surface of the protrusion in the direction of the longitudinal axis of the barrel, each protrusion further having a pair of opposed ends;

first and second coupling means for coupling the first and second ends of said body portion to said rifle barrel; and said first and second coupling means being spaced apart for connection to spaced apart portions of said rifle so that said body portion provides suspension for said rifle sling; and each of said protrusions having in cross section a height greater than its width and being substantially stiff to prevent flexing of the body portion along the length of the barrel of the rifle when rested in said recess, said protrusions further including a flexible outer covering extending along the upper surface and the opposed ends of the protrusions and being joined to the base portion to hold taut the flexible covering at the upper surface and ends of the protrusions to thereby prevent length-wise bending of said protrusions, the flexible outer covering being folded to form a generally trapezoidal pleat overlying the ends of the protrusions.

2. The rifle sling of claim 1 wherein the base of said body portion further includes a web portion between said protrusions which comprises an interior body covered by a flexible covering and which is joined by stitching to the flexible covering at the protrusion sides.

3. The rifle sling of claim 2, wherein the stitching means extends through the base so as to provide a flexible coupling of the protrusions to the web portion, so that the upper surfaces of the protrusions can be pivoted toward and away from each other to accommodate barrels of different sizes.

4. The rifle sling of claim 1 further comprising belt means extending from the second end of said body portion for connection to a portion of said rifle remote from the barrel and said second coupling means connecting said belt means to said rifle.

5. The rifle sling according to claim 1, wherein foam padding is disposed within said protrusions to support said flexible covering.

* * * * *